United States Patent [19]

Hotomi et al.

[11] Patent Number: 4,965,156

[45] Date of Patent: Oct. 23, 1990

[54]- PHOTOSENSITIVE MEMBER HAVING AN OVERCOAT LAYER AND PROCESS FOR MANUFACTURING THE SAME

[75] Inventors: Hideo Hotomi; Kenji Masaki; Shuji Iino; Izumi Osawa; Masanori Fujiwara; Isao Doi, all of Osaka, Japan

[73] Assignee: Minolta Camera Kabushiki Kaisha, Osaka, Japan

[21] Appl. No.: 318,328

[22] Filed: Mar. 3, 1989

[30] Foreign Application Priority Data

Mar. 7, 1988 [JP] Japan ..... 63-54190

[51] Int. Cl.[5] ..... G03G 5/14

[52] U.S. Cl. ..... 430/66; 430/128

[58] Field of Search ..... 430/66, 67, 58, 84, 430/95, 70, 128

[56] References Cited

U.S. PATENT DOCUMENTS

| | | | |
|---|---|---|---|
| 4,544,617 | 10/1985 | Mort et al. | 430/58 |
| 4,634,648 | 1/1987 | Jansen et al. | 430/84 |
| 4,664,999 | 5/1987 | Kakinuma et al. | 430/84 |
| 4,713,309 | 12/1987 | Johncock et al. | 430/66 |
| 4,755,444 | 7/1988 | Karakida et al. | 430/66 |

FOREIGN PATENT DOCUMENTS

| | | |
|---|---|---|
| 56-62254 | 5/1981 | Japan . |
| 60-249155 | 12/1985 | Japan . |
| 62-222262 | 9/1987 | Japan . |
| 62-294255 | 12/1987 | Japan . |
| 1174171 | 12/1969 | United Kingdom . |

OTHER PUBLICATIONS

"Properties of Diamond-Like Carbon Films", *Thin Solid Films*, vol. 119, pp. 121-126, 1984.

"Electronic Properties of Substitutionally Doped Amorphous Si and Ge", *Philosophical Magazine*, vol. 33, No. 6, pp. 935-949, 1976.

"Photosensitive Materials for Electron Photography—OPC vs. Inorganics", *Nikkei New Materials*, Dec. 15, 1986.

"A Review of Recent Advances in Plasma Engineering", *Review of Recent Advances*, Mar. 29, 1979.

*Primary Examiner*—John L. Goodrow

*Attorney, Agent, or Firm*—Burns, Doane, Swecker & Mathis

[57] ABSTRACT

The disclosure discloses a photosensitive member comprising an electrically conductive substrate, an organic photoconductive layer comprising an organic material as a matrix, and an overcoat layer comprising an amorphous carbon as a matrix and formed on said organic photoconductive layer. Said overcoat layer comprises a first overcoat layer containing fluorine atoms in an amount of about 5 atomic % or more and a second overcoat layer formed on said first overcoat layer and containing fluorine atoms in an amount of less than about 5 atomic %. Said overcoat layer has a thickness of about 0.01 to about 4.0 microns and said second overcoat layer has a thickness of about 10 to about 400 angstroms.

The disclosure also discloses a process for manufacturing the above-mentioned photosensitive member.

10 Claims, 3 Drawing Sheets

PHOTOSENSITIVE MEMBER HAVING AN OVERCOAT LAYER AND PROCESS FOR MANUFACTURING THE SAME

BACKGROUND OF THE INVENTION

1. Field of the Invention:

The present invention relates to a photosensitive member comprising an overcoat layer on a photosensitive layer of organic materials.

2. Description of the Related Art:

Remarkable progress has been made in the application of electrophotographic techniques since the invention of the Carlson process. Various materials have also been developed for use in electrophotographic photosensitive members.

Organic materials used for the construction of electrophotographic photosensitive members are well known to those skilled in the art (for example, the materials disclosed in the Dec. 15, 1986 issue of Nikkei New Materials, pages 83–98), and these materials have made superior photosensitive members practical from the standpoint of sensitivity, chargeability and construction costs.

Materials used in the construction of organic photosensitive members are, in general, photoconductive materials which produce an electric charge such as, for example, phthalocyanine series pigments, azo series pigments, perillene series pigments and the like, electrical charge transporting materials such as, for example, triphenylmethanes, triphenylamines, hydrazones, styryl compounds, pyrazolines, oxazoles, oxydiazoles, and the like, binding materials for dispersion coating such as, for example, polyester, polyvinyl butyral, polycarbonate, polyarylate, phenoxy, styrene-acryl, and other resins.

Repeated use of these types of photosensitive members, however, gives rise to the problems of image defects, white streaks, and the like. These problems arise because the surface hardness of the organic photosensitive member roughly falls within the range from the 5B to the B levels of the JIS standards for pencil lead hardness, thus the surface of the photosensitive member is readily damaged due to the friction which is generated when the member comes into contact with the transfer paper, cleaning components, developer, and the like. Another cause of such problems is the harsh surface contact made when paper jams occur and the resultant reversion to manual operation required to remedy the malfunction. Furthermore, damage to the surface of the photosensitive member results in a marked reduction in the surface potential of the member.

In order to eliminate these disadvantages, it is proposed that the surface of the photosensitive member be covered with a protective layer.

Japanese Unexamined Patent Publication No. SHO 62-156664 discloses a photosensitive member comprising an amorphous silicon photoconductive layer and an overcoat layer of amorphous carbon containing fluorine atoms. When fluorine atoms are incorporated into the amorphous carbon overcoat layer, the member exhibits excellent resistance to humidity and durability. Our inventors have found that the member exhibits a more excellent resistance to humidity if fluorine atoms are incorporated in increasing amounts into the amorphous carbon overcoat layer.

However, when an organic photosensitive member having an overcoat layer containing fluorine atoms was installed in a copy machine for carrying out the copying operation, an image fog was observed at an initial stage. This image fog may be attributed to a large electronegativity of fluorine atoms present at the surface of the overcoat layer. Our inventors assume that, when the non-image portion formed on the member comprising the overcoat layer having fluorine atoms is in contact with the developer, the developer is positively charged with respect to a photosensitive drum in the triboelectric series due to the large electronegativity of fluorine atoms. Therefore, an electrostatic attraction is developed between the developer and fluorine atoms contained in the overcoat layer. As a result, the developer is deposited onto the non-image portion formed on the photosensitive member, producing the image fog.

SUMMARY OF THE INVENTION

The main object of the present invention is to provide a photosensitive member comprising an organic photoconductive layer and an overcoat layer capable of preventing an image fog at an initial stage without impairing electrostatic characteristics and photosensitivity inherent to the organic photoconductive layer as well as resistance to humidity and durability inherent to the overcoat layer.

Another object of the present invention is to provide a process for manufacturing a photosensitive member having an organic photoconductive layer and an overcoat layer formed thereon without harm to the sensitivity characteristics of the organic photosensitive layer.

These and other objects of the present invention can be accomplished by providing a photosensitive member comprising an electrically conductive substrate, an organic photoconductive layer comprising an organic material as a matrix, and an overcoat layer comprising an amorphous carbon as a matrix and formed on the organic photoconductive layer, said overcoat layer having a first overcoat layer containing fluorine atoms in an amount of about 5 atomic % or more and a second overcoat layer formed over said first overcoat layer as an exposing layer and containing fluorine atoms in an amount of about less than 5 atomic %.

These and other objects of the present invention can further be accomplished by providing a process for manufacturing a photosensitive member having an electrically conductive substrate, an organic photoconductive layer and an overcoat layer of amorphous carbon, the process comprising a first step of forming the organic photoconductive layer on the substrate; a second step of heating the substrate on which the photoconductive layer is formed to a temperature not exceeding 100° C.; a third step of introducing gaseous materials containing fluorine atoms into a reaction chamber; a fourth step of applying electric power to cause glow discharge in the reaction chamber to thereby form the overcoat layer on the photoconductive layer, the overcoat layer comprising an amorphous carbon and fluorine atoms; and a fifth step of treating the surface of the overcoat layer with hydrogen atoms or inactive atoms to lessen the amount of fluorine atoms in the vicinity of the surface of the overcoat layer.

BRIEF DESCRIPTION OF THE DRAWINGS

In the following description, like parts are designated by like reference numbers throughout the several drawings.

FIG. 5 is a diagram showing a relationship between the flow rate and time.

DETAILED DESCRIPTION OF THE PREFERRED EMBODIMENTS

Figure 1:
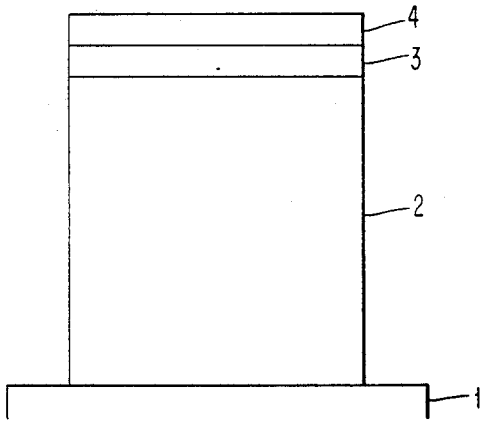
FIGS. 1 and 2 are diagrams showing a photosensitive member embodying the invention.

A photosensitive member according to the present invention comprises an electrically conductive substrate, an organic photoconductive layer formed on the substrate and an a-C overcoat layer formed on the photoconductive layer and comprising a first overcoat layer or a first overcoat layer region and a second overcoat layer or a second overcoat layer region formed on said first overcoat layer or first overcoat layer region. The overcoat layers or the overcoat layer regions comprising amorphous carbon are referred to as a-C overcoat layers hereinafter. The first overcoat layer contains fluorine atoms in an amount of about 5 atomic % or more and the second overcoat layer contains fluorine atoms in an amount of less than about 5 atomic %.

When fluorine atoms are not present in the overcoat layer, in other words, fluorine atoms are not detected by Auger electron spectroscopy, an electrical unconformity occurs between the photoconductive layer and the overcoat layer. Accordingly, residual charges are generated a memory phenomenon is produced wherein the previous image appears on the next image during a multi-copy operation, or image drift is generated due to the flow of charges at the unconformity interface. Further, the overcoat layer exhibits poor adhesivity to the organic photoconductive layer, resulting in an overcoat layer which is easily separated due to the mechanical strength in the copying machine during the actual use or the change of temperature and humidity. The above-mentioned electrical unconformity may be attributable to this poor adhesivity.

The amount of fluorine atoms incorporated in the overcoat layer as a chemical modifier can be regulated by means of increasing or decreasing the amount of fluorine compounds used in a plasma chemical vapor deposition reaction. When the fluorine compounds are introduced in increasing amounts into a reactor chamber, the amount of fluorine atoms contained in the a-C layer can be increased. On the other hand, the a-C overcoat layer has a reduced amount of fluorine atoms if the fluorine compounds are introduced in decreasing amounts into the reactor chamber.

The amount of fluorine atoms incorporated in the first a-C overcoat layer and the second a-C overcoat layer and the thickness of each layer must be determined for improving humidity resistance and preventing image fog at an initial stage.

It is preferable to incorporate a large amount of fluorine atoms in the first overcoat layer from the viewpoint of an overall improvement in the humidity resistance of the overcoat layer. In order to obtain sufficient humidity resistance under high temperature and high humidity when the member is actually used in a copying machine, the first overcoat layer desirably has incorporated therein fluorine atoms in an amount of 5 atomic % or more, and more desirably in an amount of 7 atomic % or more. The humidity resistance under high temperature and high humidity is impaired with the fluorine atoms in an amount of less than 5 atomic %.

On the other hand, it is preferable to incorporate fluorine atoms in a small amount into the second overcoat layer for preventing the generation of image fog at an initial stage. In order to sufficiently prevent the image fog at an initial stage when the member is actually used, the content of fluorine atoms is desirably at least less than 5 atomic %, and more desirably less than 2 atomic %. The amount of fluorine of 5 atomic % or more causes the image fog at an initial stage which may be attributed to the electronegativity of fluorine atoms.

The thickness of each overcoat layer is an important factor for achieving the objects of the present invention.

The entire thickness of the overcoat layer comprising the first and second overcoat layers is determined in view of durability and light transparency, the thickness preferably being 0.01 to 4.0 microns. When the thickness is less than 0.01 micron, the overcoat layer is easily influenced by low hardness of the organic photoconductive layer, failing to assure a suitable durability. The overcoat layer does not always assure a suitable visible light transmission, impairing high sensitivity inherent to the organic photoconductive layer.

The second a-C overcoat layer preferably has a thickness of about 10 to 400 angstroms. When the thickness of the second a-C overcoat layer is more than 400 angstroms, a image drift is produced under a high temperature and high humidity in the actual use due to the influence of fluorine atoms. The second a-C overcoat layer having a thickness of more than 10 angstroms can prevent the image fog at an initial stage.

According to the present invention, the starting material gases are made into an a-C film, most preferably via a plasma which is produced by a d.c. low- or high-frequency, microwave or a like plasma process.

The organic photoconductive layer of the present invention is formed by a known method such as a vacuum evaporation method.

FIG. 1 is a diagram showing the structure of a photosensitive member according to the present invention. The photosensitive member comprises in this order an electrically conductive substrate 1, an organic photoconductive layer 2 comprising an organic material as its matrix, and an overcoat layer comprising a first overcoat layer 3 containing fluorine atoms in an amount of 5 atomic % or more and a second overcoat layer 4 containing fluorine atoms in an amount of less than 5 atomic %, both the first and second overcoat layers comprising amorphous carbon as a matrix.

Figure 2:
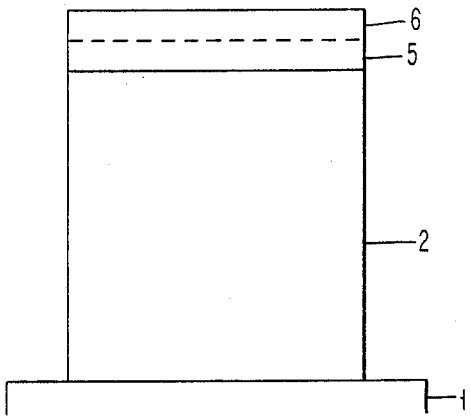

A photosensitive member shown in FIG. 2 comprises in this order an electrically conductive substrate 1, an organic photoconductive layer 2 comprising an organic material as its matrix, and an overcoat layer comprising a first overcoat layer region 5 containing fluorine atoms in an amount of 5 atomic % or more and a second overcoat layer region 6 containing fluorine atoms in an amount of less than 5 atomic %, both the first and second overcoat layer regions comprising amorphous carbon as a matrix.

The organic photoconductive layer may be a single layer having both a charge generating function and a charge transporting function or may be divided into two layers, one of which has the charge generating function and the other of which has the charge transporting function. When the temperature of the substrate is set to 100° C. or less, the organic plasma-polymerized layer can be formed on the organic photoconductive layer by the glow discharge without changing the characteristics of the organic photoconductive layer.

According to the present invention, hydrocarbons and halogen compounds are used as starting materials for forming the a-C overcoat layer. Useful examples for a carrier gas are hydrogen gas, argon gas or the like.

These hydrocarbons need not always be in a gaseous phase at room temperature and atmospheric pressure but can be in a liquid or solid phase insofar as they can be vaporized on melting, evaporation or sublimation, for example, by heating or in a vacuum. Examples of useful hydrocarbons are saturated hydrocarbons, unsaturated hydrocarbons, alicyclic hydrocarbons, aromatic hydrocarbons and the like. Such hydrocarbons are usable in combination.

A wide variety of hydrocarbons are usable. Examples of useful saturated hydrocarbons are methane, ethane, propane, butane, pentane, hexane, heptane, octane, isobutane, isopentane, neopentane, isohexane, neohexane, dimethylbutane, methylhexane, ethylpentane, dimethylpentane, tributane, methylheptane, dimethylhexane, trimethylpentane, isononane, and the like.

Examples of useful unsaturated hydrocarbons are ethylene, propylene, isobutylene, butene, pentene, methylbutene, hexene, tetramethylethylene, heptene, octene, allene, methyl-allene, butadiene, pentadiene, hexadiene, cyclopentadiene, ocimene, alloocimene, myrcene, hexatriene, acetylene, diacetylene, methyl-acetylene, butyne, pentyne, hexyne, heptyne, octyne, and the like.

Examples of useful alicyclic hydrocarbons are cyclopropane, cyclobutane, cyclopentane, cyclohexane, cycloheptane, cyclooctane, cyclopropene, cyclobutene, cyclopentene, cyclohexene, cycloheptene, cyclooctene, limonene, terpinolene, phellandrene, sylvestrene, thujene, carene, pinene, bornylene, camphene, fenchene, cyclofenchene, tricyclene, bisabolene, zingiberene, curcumene, humulene, cadinenesesquibenihene, selinene, caryophyllene, santalene, cedrene, camphorene, phyllocladene, podocarprene, mirene and the like.

Examples of useful aromatic hydrocarbons are benzene, toluene, xylene, hemimellitene, pseudocumene, mesitylene, prehnitene, isodurene, durene, pentamethylbenzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene and the like.

According to the present invention, fluorine compounds are used in addition to hydrocarbons in order to incorporate atoms of fluorine into the a-C overcoat layer. The fluorine compounds to be used need not always be in a gaseous phase at room temperature and atmospheric pressure but can be in a liquid or solid phase insofar as they can be vaporized on melting, evaporation or sublimation, for example, by heating or in a vacuum. Examples of useful fluorine compounds are inorganic compounds such as fluorine, chlorine fluoride, bromine fluoride, iodine fluoride; and organic compounds such as alkane fluorides, alkyl metal fluorides, aryl fluorides, styrene fluorides, alkene fluorides, fluorine substituted silane and the like. Examples of such alkane fluorides are perfluoromethane, perfluoroethane, perfluoropropane, perfluorobutane, perfluorohexance and the like. Examples of such alkyl metal fluorides are dimethylaluminum fluoride, trimethyltin fluoride, diethyltin difluoride and the like. Examples of useful aryl fluorides are perfluorobenzene, perfluorotoluene and the like. Examples of useful styrene fluorides are perfluorostyrene and the like. Examples of useful alkene fluorides are perfluoroethylene, perfluoropropene, perfluorobutene, perfluorohexene, perfluorooctene and the like. Examples of useful fluorine substituted silanes are hexafluorosilane and the like.

Figure 3:
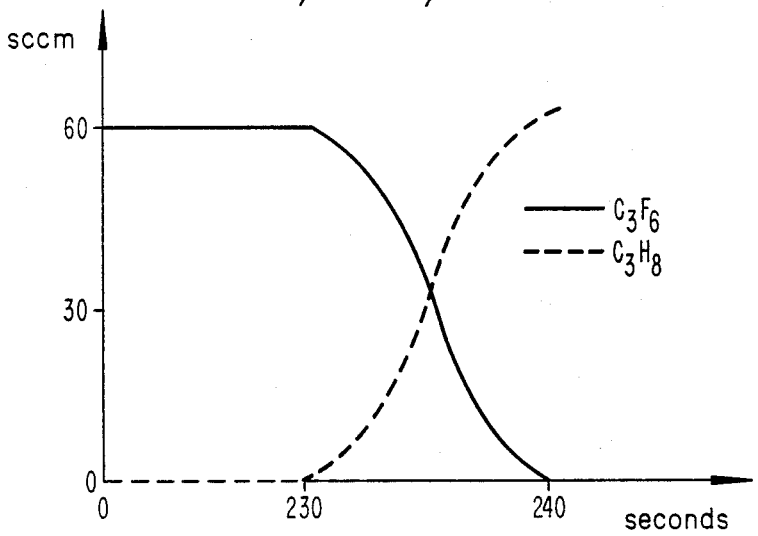
FIGS. 3 and 4 are diagrams showing apparatus for preparing photosensitive members of the invention.
Figure 3:
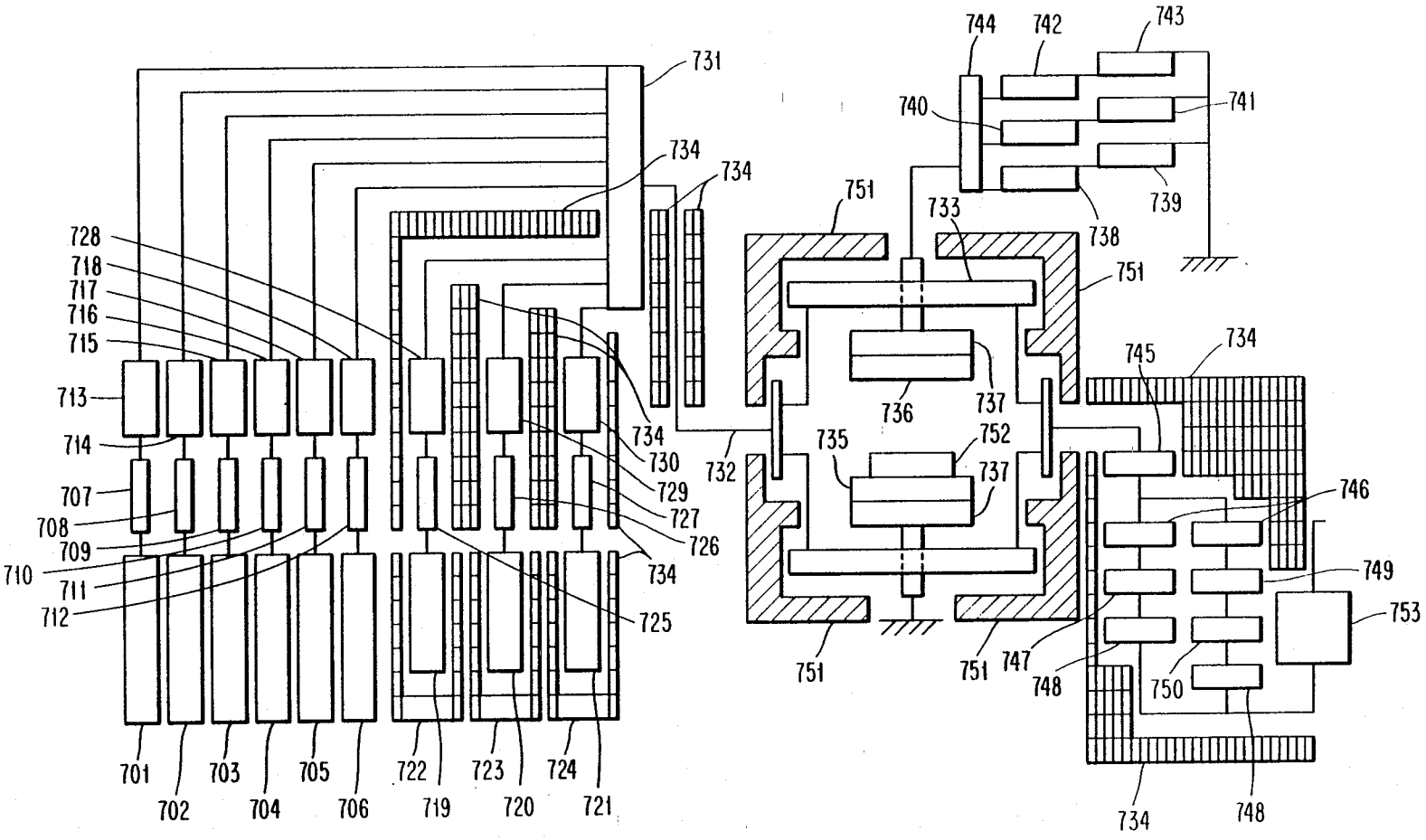

FIG. 3 shows an apparatus for preparing the a-C overcoat layer of the invention. First to sixth tanks 701 to 706 have enclosed therein starting material compounds which are in gas phase at room temperature and a carrier gas and are connected respectively to first to sixth regulator valves 707 to 712 and first to sixth flow controllers 713 to 718. First to third containers 719 to 721 contain starting material compounds which are liquid or solid at room temperature, can be preheated by first to third heaters 722 to 724 for vaporizing the compounds, and are connected to seventh to ninth regulator valves 725 to 727 and seventh to ninth flow controllers 728 to 730, respectively. The gases to be used as selected from among these gases are mixed together by a mixer 731 and fed to a reactor 733 via a main pipe 732. The interconnecting piping can be heated by a pipe heater 734 which is suitably disposed so that the material compound, in a liquid or solid phase at room temperature and vaporized by preheating, will not condense during transport. A grounded electrode 735 and a power application electrode 736 are arranged as opposed to each other within the reactor 733. Each of these electrodes can be heated by an electrode heater 737. The power application electrode 736 is connected to a high-frequency power source 739 via a high-frequency power matching device 738, to a low-frequency power source 741 via a low-frequency power matching device 740 and to a d.c. power source 743 via a low-pass filter 742. Power of one of the different frequencies is applicable to the electrode 736 by way of a connection selecting switch 744. The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via another exhaust system selecting value 746. The exhaust gas is further made harmless by a suitable removal device 753 and then released to the atmosphere. The evacuation piping system can also be heated by a suitably disposed pipe heater 734 so that the material compound which is liquid or solid at room temperature and vaporized by preheating will not condense during transport. For the same reason, the reactor 733 can also be heated by a reactor heater 751. An electrically conductive substrate 752 is placed on the electrode 735 in the reactor. Although FIG. 3 shows that the substrate 752 is fixed to the grounded electrode 735, the substrate may be attached to the power application electrode 736, or to both the electrodes.

Figure 4:
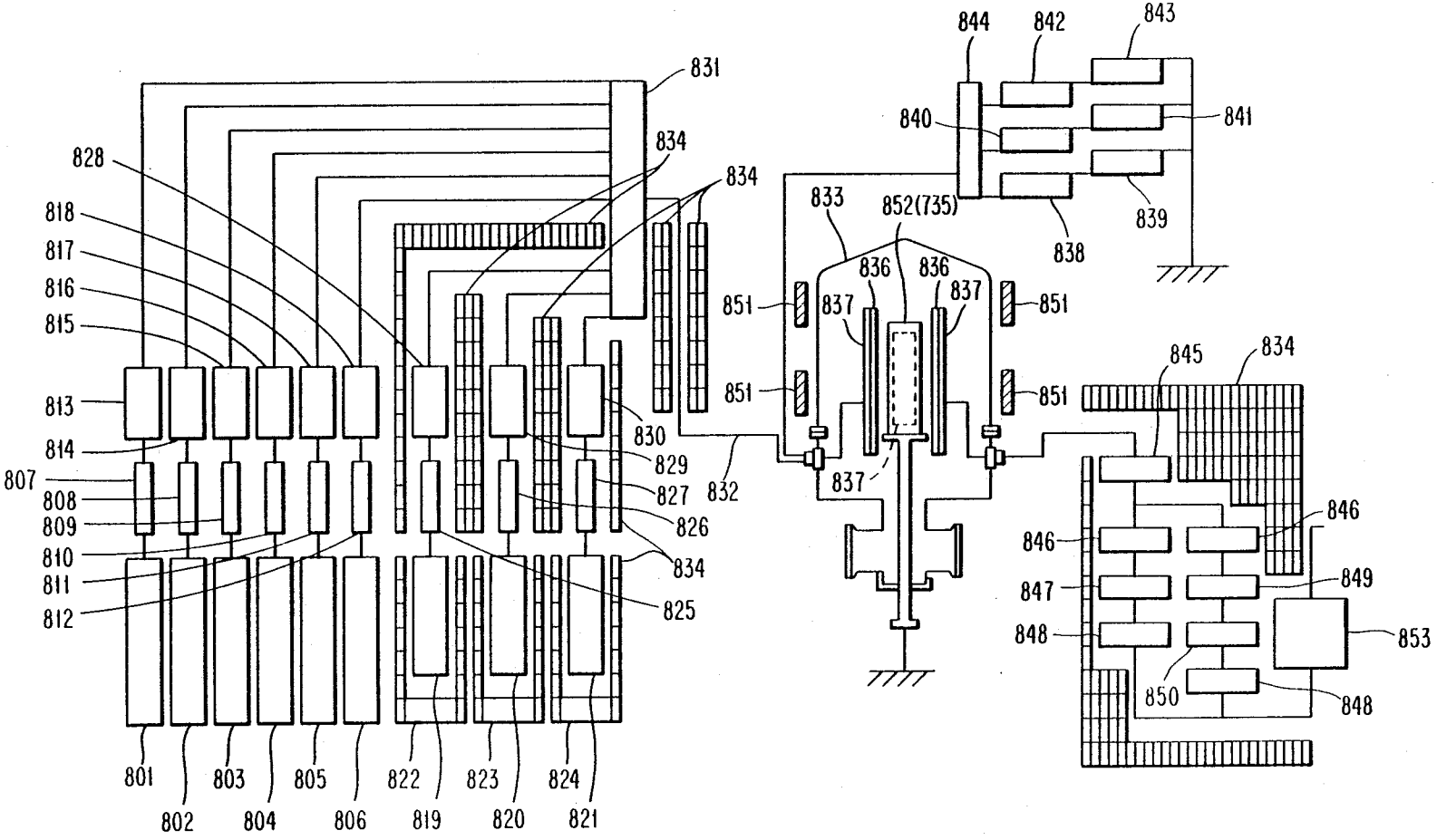

FIG. 4 shows another type of apparatus for preparing the a-C overcoat layer of the photosensitive member according to the invention. This apparatus has the same construction as the apparatus of FIG. 3 with the exception of the interior arrangement of the reactor 333. The numerals shown by 700 order in FIG. 3 are replaced by the numerals at 300 order in FIG. 4.

With reference to FIG. 4, the reactor 833 is internally provided with a hollow cylindrical electrically conductive substrate 852 serving also as the grounded electrode 835 of FIG. 3 and internally provided with an electrode heater 837. A power application electrode 836, similarly in the form of a hollow cylinder, is provided around the substrate 852 and surrounded by an electrode heater 837. The conductive substrate 852 is rotatable about its own axis by a motor from outside.

The reactor for preparing the photosensitive member is first evacuated by the diffusion pump to a vacuum of about $10^{-4}$ to about $10^{-6}$ torr, whereby the adsorbed gas inside the reactor is removed. The reactor is also checked for the degree of vacuum. At the same time, the electrodes and the substrate fixedly placed on the electrode are heated to a predetermined temperature. In order to prevent heat conversion of the organic photoconductive layer, it is desirable that the substrate temperature be set at 100° C. or less (room temperature to 100° C.). Subsequently, material gases are fed into the reactor from the first to sixth tanks and the first to third containers (i.e. from those concerned), each at a specified flow rate, using the flow controllers concerned, i.e. first to ninth flow controllers and the interior of the reactor is maintained in a predetermined vacuum by the pressure control valve. After the combined flow of gases has become stabilized, the high-frequency power source, for example, is selected by the connection selecting switch to apply a high-frequency power to the power application electrode. This initiates discharge across the two electrodes, forming a solid layer on the substrate with time. The thickness of the layer is controllable by varying the reaction time, such that the discharge is discontinued upon the thickness reaching the desired value.

By the process described above, the photosensitive member having an a-C overcoat layer of the present invention can be obtained. The obtained a-C overcoat layer is an organic plasma-polymerized layer comprising fluorine atoms.

The present invention will be described with reference to the following examples.

MANUFACTURE OF ORGANIC PHOTOSENSITIVE LAYER A

A fluid dispersion of 2 parts dis-azo compound (G-1) as shown in Table 2-1, 1 part polyester resin (Toyobo Co., V-500), and 100 parts methyl ethyl ketone, was subjected to a dispersion process using a ball mill for 24 hours. A cylindrical aluminum substrate measuring 80 mm in diameter by 330 mm in length was coated with this fluid dispersion via a dipping process so as to form a film layer having a thickness of 3,000 angstroms, thereby forming a charge generating layer.

Next, a coating comprising 10 parts hydrazone compound (T-1) as shown in Table 2-2 and 10 parts polycarbonate resin (Teijin Kasei Co., K-1300) dissolved in 80 parts tetrahydrofuran was applied to the charge generating layer so as to form a layer having a thickness of 20 microns after drying, said layer then being dried to form a charge transporting layer, thereby forming the organic photoconductive layer A.

COMPARATIVE EXAMPLE 1

The organic photoconductive layer A obtained by the previously described process was subjected to an initial charge (hereinafter referred to as $V_0$) of −600V using the corona discharge during the normal Carlson process. The measured amount of light required to reduce the surface potential by half (hereinafter referred to as E1/2) was 1.8 lux-sec., and the residual potential (hereinafter referred to as Vr) was −5V. Also, the photosensitive member A had a surface hardness ratings of approximately 5B based on measurements for pencil lead hardness as provided in Japanese Industrial Standards JIS K-5400. When the photosensitive member A was installed in actual copying machines (Minolta Model EP470Z) and subjected to resistance tests comprising the making of 10,000 A4 size copies, a loss of layer thickness of approximately 2.0 microns was observed. From these results, it can be understood that although the organic photosensitive member of the present invention was observed to possess superior electrostatic characteristics, the member was observed to be poor in durability.

MANUFACTURE OF ORGANIC PHOTOSENSITIVE LAYER B

A fluid dispersion of 2 parts dis-azo compound (G-2) as shown in Table 2-1, 1 part polyester resin (Toyobo Co., V-500), and 100 parts methyl ethyl ketone was subjected to a dispersion process using a ball mill for 24 hours. A cylindrical aluminum substrate measuring 80 mm in diameter by 330 mm in length was coated with this fluid dispersion via a dipping process so as to form a film layer having a thickness of 2,500 angstroms, thereby forming a charge generating layer.

Next, a coating comprising 10 parts styryl compound (T-2) as shown in Table 2-2 and 10 parts polyarylate resin (Unichika Co., U-4000) dissolved in 85 parts tetrahydrofuran was applied to the charge generating layer so as to form a layer having a thickness of 20 microns after drying, said layer then being dried to form a charge transporting layer, thereby forming the organic photoconductive layer B.

COMPARATIVE EXAMPLE B

Evaluations of the organic photoconductive layer B were conducted using the same criteria as for Comparative Example A; the results are shown in Table 1.

From these results, it can be understood that although the organic photosensitive member of the present invention was observed to possess superior electrostatic characteristics, the member was observed to be poor in durability.

MANUFACTURE OF ORGANIC PHOTOSENSITIVE LAYER C

A fluid dispersion of 2 parts dis-azo compound (G-3) as shown in Table 2-1, 1 part polyester resin (Toyobo Co., V-500), and 100 parts methyl ethyl ketone was subjected to a dispersion process using a ball mill for 24 hours. A cylindrical aluminum substrate measuring 80 mm in diameter by 330 mm in length was coated with this fluid dispersion via a dipping process so as to form a film layer having a thickness of 3,000 agstroms, thereby forming a charge generating layer.

Next, a coating comprising 10 parts stilbene compound (T-3) as shown in Table 2-2 and 10 parts methyl methacrylate resin (Mitsubishi Rayon, BR-85) dissolved in 80 parts tetrahydrofuran was applied to the charge generating layer so as to form a layer having a thickness of 20 microns after drying, said layer then being dried to form a charge transporting layer, thereby forming the organic photoconductive layer C.

COMPARATIVE EXAMPLE C

Evaluations of the organic photoconductive layer C were conducted using the same criteria as for Comparative Example A; the results are shown in Table 1.

From these results, it can be understood that although the organic photosensitive member of the present invention was observed to possess superior electrostatic characteristics, the member was observed to be poor in durability.

TABLE 1

| Comparative Example | V0 (V) | E½ (lux-sec) | Vr (V) | Hardness | Film Loss (μm) |
|---|---|---|---|---|---|
| Ex. A | −600 | 1.8 | −5 | 5B | 2.0 |
| Ex. B | −600 | 1.0 | −4 | 5B | 1.8 |
| Ex. C | −600 | 2.1 | −7 | 5B | 2.2 |

TABLE 2-1

Charge generating Materials

G-1

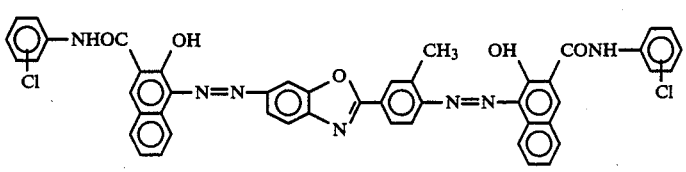

G-2

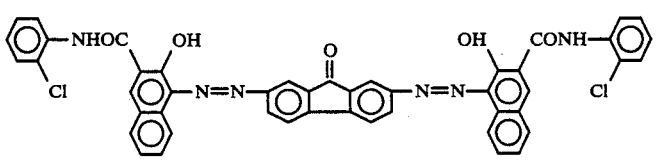

G-3

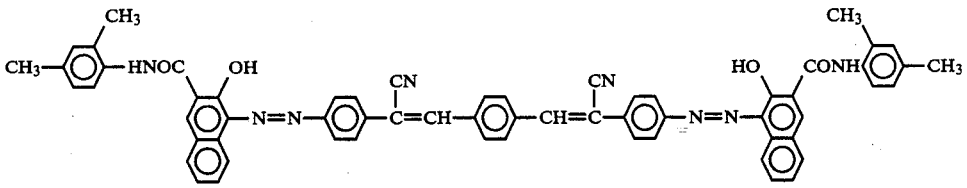

TABLE 2-2

Charge Transporting Materails

T-1

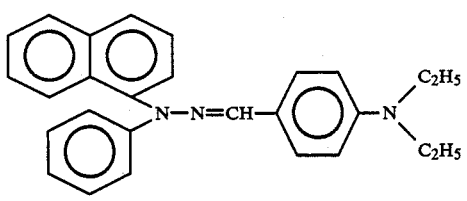

T-2

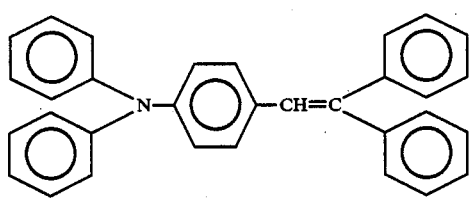

T-3

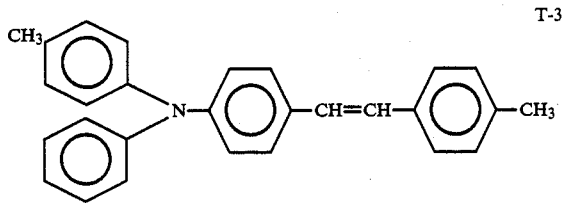

EXAMPLE 1

Using a glow discharge decomposition apparatus shown in FIG. 4, an overcoat layer of the present invention for a photosensitive member was prepared.

First, the interior of the reactor 833 was evacuated to a high vacuum of about $10^{-6}$ torr, and the first and second regulator valves 807 and 808 were thereafter opened to introduce perfluoropropylene gas from the first tank 801 and hydrogen gas from the second tank 802 into the first flow controller 813 and the second flow controller 814 respectively at an output pressure of 2.0 kg/cm$^2$. The dials on the flow controllers were adjusted to supply the perfluoropropylene gas at a flow rate of 60 sccm and the hydrogen gas at a flow rate of 120 sccm to the reactor 833 through the main pipe 832 via the intermediate mixer 831. After the flows of the gases were stabilized, the internal pressure of the reactor 833 was adjusted to 0.5 torr by the pressure control valve 845. On the other hand, the organic photoconductive layer A was used as the substrate 852, said substrate being preheated to a temperature of 50° C. With the gas flow rates and the pressure in a stabilized state, 100-watt power with a frequency of 200KHz was applied to the power application electrode 836 from the low-frequency power source 841 preconnected thereto by the selecting switch 844 to conduct plasma polymerization for 3 minutes, forming a first a-C overcoat layer, 0.25 microns in thickness, on the organic photoconductive layer A.

When subjected to Auger electron spectroscopy, the first a-C overcoat layer was found to contain 12 atomic % of fluorine atoms.

Further, the interior or the reactor 833 was evacuated to a high vacuum of about $10^{-6}$ torr, and second and third regulator valves 807 and 808 were thereafter opened to introduce 1,4-butadiene gas from the third tank 803 and hydrogen gas from the second tank 802 into the third and second flow controller 815 and 814 respectively at an output pressure of 2.0 kg/cm$^2$. The dials on the flow controllers were adjusted to supply the butadiene gas at a flow rate of 15 sccm and the hydrogen gas at 300 sccm to the reactor 833. After the flows of the gases are stabilized, the internal pressure of the reactor 833 was adjusted to 0.5 torr. With the gas flow rates and the pressure in a stabilized state, 200-watt power with a frequency of 50KHz was applied to the power application electrode 836 from the low-frequency power source 841 preconnected thereto to conduct plasma polymerization for 3 seconds, forming a second a-C overcoat layer having a thickness of 40 angstroms. When subjected to Auger electron spectroscopy, the second a-C overcoat layer was found to contain 0.5 atomic % of fluorine atoms. Thus, the overcoat layer comprising amorphous carbon as a matrix was formed.

EXAMPLE 2

Using a glow discharge decomposition apparatus shown in FIG. 4, an overcoat layer of the present invention for a photosensitive member was prepared.

First, the interior of the reactor 833 was evacuated to a high vacuum of about $10^{-6}$ torr, and the first, second and third regulator valves 807, 808 and 809 were thereafter opened to introduce perfluoropropylene gas from the first tank 801, hydrogen gas from the second tank 802 and propylene gas from the third tank 803 into the first flow controller 813, the second flow controller 814 and the third flow controller 815 respectively at an output pressure of 2.0 kg/cm$^2$. The dials on the flow controllers were adjusted to supply the perfluoropropylene gas at a flow rate of 60 sccm, the hydrogen gas at a flow rate of 120 sccm and the propylene gas at 0 sccm to the reactor 833 through the main pipe 832 via the intermediate mixer 831. After the flows of the gases were stabilized, the internal pressure of the reactor 833 was adjusted to 0.5 torr by the pressure control valve 845. On the other hand, the organic photoconductive layer C was used as the substrate 852, said substrate being preheated to a temperature of 50° C. With the gas flow rates and the pressure in a stabilized state, 300-watt power with a frequency of 200KHz was applied to the power application electrode 836 from the low-frequency power source 841 preconnected thereto by the selecting switch 844 to conduct plasma polymerization for 230 seconds. Then, the first and third flow controllers 813 and 815 were adjusted to set the flow rate of the perfluoropropylene gas to 0 sccm and the propylene gas to 60 sccm. Each of the flow rates were slowly changed as shown in FIG. 5 since a buffer effect was produced due to the response speed of the flow controllers and contents in tube from the flow controllers to the reactor. Thereafter, plasma polymerization was conducted for 10 seconds. Therefore, plasma polymerization was totally conducted for 3 minutes, forming an overcoat layer having a thickness of 0.35 microns on the organic photoconductive layer C. The formed overcoat layer comprises in this order a first overcoat layer region containing fluorine atoms in an amount of 15 atomic % and having a thickness of 0.34 microns and a second overcoat layer region containing fluorine atoms in an amount of 0.01 atomic % and having a thickness of 0.01 micron.

EXAMPLE 3

Using a glow discharge decomposition apparatus shown in FIG. 4, an overcoat layer of the present invention for a photosensitive member was prepared.

First, the interior of the reactor 833 was evacuated to a high vacuum of about $10^{-6}$ torr, and the first and second regulator valves 807 and 808 were thereafter opened to introduce perfluoropropylene gas from the first tank 801 and hydrogen gas from the second tank 802 into the first flow controller 813 and the second flow controller 814 respectively at an output pressure of 2.0 kg/cm$^2$. The dials on the flow controllers were adjusted to supply the perfluoropropylene gas at a flow rate of 60 sccm and the hydrogen gas at a flow rate of 120 sccm to the reactor 833 through the main pipe 832 via the intermediate mixer 831. After the flows of the gases were stabilized, the internal pressure of the reactor 833 was adjusted to 0.5 torr by the pressure control valve 845. On the other hand, the organic photoconductive layer B was used as the substrate 852, said substrate being preheated to a temperature of 50° C. With the gas flow rates and the pressure in stabilized state, 200-watt power with a frequency of 200KHz was applied to the power application electrode 836 from the low-frequency power source 841 preconnected thereto by the selecting switch 844 to conduct plasma polymerization for 3 minutes, forming a first a-C overcoat layer, 0.25 microns in thickness, on the organic photoconductive layer B.

Further, the interior or the reactor 833 was evacuated to a high vacuum of about $10^{-6}$ torr, and second regulator valve 808 was thereafter opened to introduce hydrogen gas from the second tank 802 into the second flow controller 814 at an output pressure of 2.0 kg/cm$^2$. The dials on the flow controllers were adjusted to supply the hydrogen gas at 200 sccm to the reactor 833. After the flows of the gases are stabilized, the internal pressure of the reactor 833 was adjusted to 1.0 torr. With the gas flow rates and the pressure in a stabilized state, 100-watt power with a frequency of 100KHz was applied to the power application electrode 836 from the low-frequency power source 841 preconnected thereto to conduct plasma polymerization for 15 seconds, treating the surface of the first overcoat layer with hydrogen. As a result, fluorine atoms contained at the surface of the first overcoat layer are dissociated from the overcoat layer to the outside, so that the first overcoat layer region containing fluorine atoms in an amount of 10 atomic % and having a thickness of 0.25 micron and a second overcoat layer region containing fluorine atoms in an amount of 0.1 atomic % and having a thickness of 0.04 micron were laminated in this order on the organic photoconductive layer B.

EXAMPLE 4

A photosensitive member was prepared as similarly as with Example 3 except that the argon gas instead of hydrogen was introduced from the third tank 803 into the third flow controller 815 at a flow rate of 120 sccm for forming the first a-C overcoat layer. The thickness and fluorine contents of each of the first and second a-C overcoat layers are the same as those in Example 3.

COMPARATIVE EXAMPLE 1

A photosensitive member was prepared as similarly as with Example 1 except that a single a-C overcoat layer containing fluorine atoms in an amount of 50 atomic % was formed on the organic photoconductive layer A instead of the overcoat layer comprising a first and second overcoat layers. This single a-C overcoat layer was observed to have a thickness of 0.5 micron.

EVALUATION

The photosensitive members obtained by Examples 1 to 4 and Comparative Example 1 were subjected to an initial charge of −600V using the corona discharge during the normal Carlson process. The amount of E1/2 and $V_r$ were measured. Further, the surface hardness ratings based on measurements for pencil lead hardness as provided in Japanese Industrial Standards JIS K-5400 were measured.

The photosensitive members were installed in actual copying machines (Minolta Model EP470Z) and subjected to resistance tests comprising the making of 100,000 A4 size copies to observe a loss of layer thickness. Moreover, the members were subjected to high temperature and high humidity (temperature of 35° C. and humidity of 85%) to observe an image drift and image fog at an initial stage.

These results are shown in Table 3.

The results of the evaluation shown in Table 3 are classified into 8 items (1) to (8) as follows:

(1) initial charging potential (V)

(2) residual potential (V)

(3) E(1/2) (lux-seconds)

(4) hardness (H)

(5) layer loss after resistance tests for making 100,000 A4 size copies (μm)

(6) image drift at an initial stage under high temperature and high humidity (7) image drift after resistance tests for making 100,000 A4 size copies under high temperature and high humidity (8) image fog at an initial stage under high temperature and high humidity With respect to the items (6) to (8), the mark 0 represents that the members had no image drift or image fog, while the mark x represents that the members were observed to have image drift or image fog.

TABLE 3

| Ex. No. | (1) V | (2) V | (3) lux-seconds | (4) H | (5) μm | (6) | (7) | (8) |
|---|---|---|---|---|---|---|---|---|
| 1 | −600 | −5 | 1.8 | 5 | 0 | 0 | 0 | 0 |
| 2 | −600 | −7 | 2.1 | 5 | 0 | 0 | 0 | 0 |
| 3 | −600 | −4 | 1.0 | 5 | 0 | 0 | 0 | 0 |
| 4 | −600 | −5 | 1.8 | 5 | 0 | 0 | 0 | 0 |
| Com. Ex. 1 | −600 | −5 | 1.8 | 5 | 0 | 0 | 0 | x |

What is claimed is:

1. A photosensitive member comprising:

an electrically conductive substrate;

an organic photoconductive layer formed on said electrically conductive substrate and comprising an organic material as a matrix; and an overcoat layer having first and second overcoat regions and formed on said photoconductive layer, said first overcoat region comprising amorphous carbon which contains fluorine atoms in an amount of about 5 atomic % or more, said second overcoat region formed over said first overcoat region and comprising amorphous carbon which contains fluorine atoms in an amount of less than about 5 atomic % which is less than the amount contained in said first overcoat region, said overcoat layer having a thickness of about 0.01 to about 4.0 microns with said second overcoat region having a thickness of about 10 to about 400 angstroms.

2. A photosensitive member as claimed in claim 1, wherein said first overcoat region preferably contains fluorine atoms in an amount of about 7 atomic % or more.

3. A photosensitive member as claimed in claim 1, wherein said second overcoat region preferably contains fluorine atoms in an amount of less than about 2 atomic %.

4. A process for manufacturing a photosensitive member having an electrically conductive substrate, an organic photoconductive layer and an overcoat layer of amorphous carbon, said process comprising:

a first step of forming the organic photoconductive layer on the substrate;

a second step of heating the substrate on which the photoconductive layer is formed to a temperature not exceeding 100° C.;

a third step of introducing gaseous materials containing fluorine atoms into a reaction chamber;

a fourth step of applying electric power to cause glow discharge in the reaction chamber to thereby form the overcoat layer on the photoconductive layer, said overcoat layer comprising an amorphous carbon and fluorine atoms; and a fifth step of treating the surface of the overcoat layer with hydrogen atoms or inactive atoms to lessen the amount of fluorine atoms in the vicinity of the surface of said overcoat layer.

5. A photosensitive member comprising:

an electrically conductive substrate;

a photoconductive layer formed on said electrically conductive substrate; and an overcoat layer having first and second overcoat regions and formed on said photoconductive layer, said first overcoat region comprising amorphous carbon which contains fluorine atoms in an amount of about 5 atomic % or more, said second overcoat region formed over said first overcoat region and comprising an amorphous carbon which contains fluorine atoms in an amount of less than about 5 atomic % which is less than the amount contained in said first overcoat region, said overcoat layer having a thickness of about 0.01 to about 4.0 microns with said second overcoat region having a thickness of about 10 to about 400 angstroms.

6. A photosensitive member as claimed in claim 5, wherein said photoconductive layer comprises a charge generating layer and a charge transporting layer.

7. A photosensitive member as claimed in claim 5, wherein said photoconductive layer comprises a single layer having both a charge generating function and a charge transporting function.

8. A photosensitive member comprising:

an electrically conductive substrate;

a photoconductive layer formed on said electrically conductive substrate; and an overcoat layer formed on said photoconductive layer and comprising amorphous carbon which contains fluorine atoms, said fluorine atoms being contained in an amount of about 5 atomic % or more at the adjacency of the boundary with said photoconductive layer and the amount being minimum at the outermost surface of said overcoat layer, said overcoat layer having a thickness of about 0.01 to about 4.0 microns.

9. A process for manufacturing a photosensitive member having an amorphous carbon overcoat layer formed on a photoconductive layer, said overcoat layer containing fluorine atoms with the amount thereof minimum at the surface of the overcoat layer, said process comprising:

a first step of providing an electrically conductive substrate;

a second step of forming the photoconductive layer on the substrate;

a third step of heating the substrate to a predetermined temperature;

a fourth step of introducing gaseous materials containing fluorine atoms into a reaction chamber;

a fifth step of applying electric power to cause glow discharge in the reaction chamber to thereby form the overcoat layer on the photoconductive layer, said overcoat layer comprising amorphous carbon and fluorine atoms; and a sixth step of treating the surface of the overcoat layer with hydrogen atoms or inactive atoms to lessen the amount of fluorine atoms in the vicinity of the surface of said overcoat layer.

10. A process for manufacturing a photosensitive member having an amorphous carbon overcoat layer formed on a photoconductive layer, said overcoat layer containing fluorine atoms with the amount thereof minimum at the surface of the overcoat layer, said process comprising:

a first step of providing an electrically conductive substrate;

a second step of forming the photoconductive layer on the substrate;

a third step of heating the substrate to a predetermined temperature;

a fourth step of introducing gaseous materials containing fluorine atoms into a reaction chamber;

a fifth step of applying electric power to cause glow discharge in the reaction chamber to thereby form the first overcoat region on the photoconductive layer, said first overcoat region comprising amorphous carbon and fluorine atoms in an amount of about 5 atomic % or more;

a sixth step of introducing gaseous materials not containing fluorine atoms into a reaction chamber; and a seventh step of applying electric power to cause glow discharge in the reaction chamber to thereby form the second overcoat region on the first overcoat region, said second overcoat region comprising amorphous carbon and fluorine atoms in an amount of less than about 5 atomic %.

* * * * *